US011021957B2

(12) United States Patent
Keegan

(10) Patent No.: US 11,021,957 B2
(45) Date of Patent: Jun. 1, 2021

(54) GAS TURBINE ENGINE ROTOR DISC RETENTION ASSEMBLY

(71) Applicant: Siemens Aktiengesellschaft, Munich (DE)

(72) Inventor: Colm Keegan, Nettleham (GB)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 42 days.

(21) Appl. No.: 16/611,026

(22) PCT Filed: May 18, 2018

(86) PCT No.: PCT/EP2018/063206
§ 371 (c)(1),
(2) Date: Nov. 5, 2019

(87) PCT Pub. No.: WO2018/215370
PCT Pub. Date: Nov. 29, 2018

(65) Prior Publication Data

US 2020/0190983 A1 Jun. 18, 2020

(30) Foreign Application Priority Data

May 26, 2017 (EP) ..... 17173117

(51) Int. Cl.
*F01D 5/02* (2006.01)
*F01D 5/06* (2006.01)

(52) U.S. Cl.
CPC ..... *F01D 5/02* (2013.01); *F01D 5/025* (2013.01); *F01D 5/06* (2013.01); *F05D 2240/24* (2013.01); *F05D 2250/73* (2013.01)

(58) Field of Classification Search
CPC . F01D 5/02; F01D 5/021; F01D 5/025; F01D 5/34; F01D 5/06; F01D 5/066; F05D 2240/24; F05D 2250/73; F05D 2260/941
See application file for complete search history.

(56) References Cited

U.S. PATENT DOCUMENTS 4,468,148 A 8/1984 Seymour
4,844,694 A 7/1989 Naudet
(Continued)

FOREIGN PATENT DOCUMENTS

EP 1512834 A2 3/2005
EP 1801349 A1 6/2007
EP 1882813 A2 1/2008

OTHER PUBLICATIONS

International search report and written opinion dated Dec. 17, 2018 for corresponding PCT/EP2018/063206.

*Primary Examiner* — Courtney D Heinle
*Assistant Examiner* — Danielle M. Christensen

(57) ABSTRACT

A rotor disc retention assembly of a gas turbine includes a tension bolt, a rotor disc with a hub, a web, a blade retention arrangement, a rotational axis, a first axial side and a second axial side. The hub has a central bore around the rotational axis. The web is integrally formed with and extends radially outwards from the hub to the blade retention arrangement. The blade retention arrangement has a centre of mass. A radial plane perpendicular to the rotational axis passes through the centre of mass. The first axial side engages the tension bolt. The radial plane intersects the hub defining a first axial side portion towards the first axial side and a second axial side portion towards the second axial side. The second axial side portion has an axial extent which is between 10% and 30% greater than an axial extent of the first axial side portion.

9 Claims, 6 Drawing Sheets

(56) References Cited

U.S. PATENT DOCUMENTS

| | | | | |
|---|---|---|---|---|
| 5,215,440 | A * | 6/1993 | Narayana | F01D 5/06 416/198 A |
| 2008/0025843 | A1 | 1/2008 | Scope et al. | |
| 2020/0109632 | A1 * | 4/2020 | Lucey | F01D 5/06 |

* cited by examiner

GAS TURBINE ENGINE ROTOR DISC RETENTION ASSEMBLY

CROSS REFERENCE TO RELATED APPLICATIONS

This application is the US National Stage of International Application No. PCT/EP2018/063206 filed 18 May 2018, and claims the benefit thereof. The International Application claims the benefit of European Application No. EP17173117 filed 26 May 2017. All of the applications are incorporated by reference herein in their entirety.

FIELD OF INVENTION

The present invention relates to gas turbine engines, and more particularly to rotor discs of gas turbine engines.

BACKGROUND OF INVENTION

Turbine blades in various modern gas turbine engines are arranged on rotor discs. A plurality of the blades is arranged circumferentially on the rotor disc. The rotor disc has a central hole, i.e. a central bore through which a tension bolt passes when the rotor disc along with the circumferentially assembled turbine blades is positioned within the gas turbine engine. A shaft is connected to the rotor disc by generally using a Hirth joint or Hirth coupling. When the gas turbine engine is operated, in such a rotor disc with the central hole and the Hirth coupling an unsymmetrical stress distribution is produced with peak stress around the central bore of the hub at the side opposite to where the bolt load is applied. The aforementioned rotor disc and its arrangement within a gas turbine are explained hereinafter in further details with respect to FIGS. 2 and 3.

FIG. 2 schematically depicts a conventionally known rotor disc 99, and FIG. 3 schematically depicts the conventionally known rotor disc 99 when positioned within a gas turbine. The conventionally known rotor disc 99, hereinafter also referred to as the rotor disc 99, has a hub 60, a web 70 and a blade retention arrangement 80. The hub 60 is region or part of the rotor disc 99 that surrounds a central hole 11 or central bore 11. The central bore 11 is arranged around a rotational axis 15 of the rotor disc 99 when the rotor disc 99 is positioned inside the gas turbine, as depicted in FIG. 3. From the hub 60 extends radially outwards the web 70 which is section of the rotor disc 99 that connects the hub 60 to the blade retention arrangement 80. The blade retention arrangement 80 usually comprises slots (not shown in FIGS. 2 and 3) into which roots (not shown in FIGS. 2 and 3) of a plurality of turbine blades (not shown in FIGS. 2 and 3) are arranged or fixed. Thus the turbine blades are circumferentially arranged on the rotor disc 99 and extend radially outwards from the rotor disc 99, and particularly from the blade retention arrangement 80 of the rotor disc 99.

As shown in FIG. 3, a tension bolt 4 of the gas turbine passes through the central bore 11 and is physically contacted at a first axial side 91 of the rotor disc 99. The tension bolt 4 bears the load of the rotor disc 99 along with the turbine blades arranged on the rotor disc 99 when the rotor disc 99 along with the turbine blades are rotated while operating the gas turbine. On a second axial side 92 of the rotor disc 99, the rotor disc 99 is contacted or coupled with a drive shaft 3 of the gas turbine via generally Hirth coupling 2. The location of the Hirth coupling 2 is also depicted in FIG. 2 although FIG. 2 does not schematically depict the Hirth coupling 2 in its entirety with the drive shaft 3. The drive shaft 3 rotationally couples the gas turbine to a downstream load for example a generator (not shown).

In such conventionally known rotor disc 99 having the central bore 11, which is subject to offset loading, the rotor disc 99 is subjected to dishing, and a high stress is created in the hub 60 around the central bore 11 of the rotor disc 99, generally with peak stress around an edge 93 of the hub 60 around the central bore 11 at the side opposite to where the bolt load is applied i.e. at the second side 92 in the examples of FIGS. 2 and 3. FIG. 10 schematically depicts a stress location 65 in the hub 60 of the conventionally known rotor disc 99 when functioning within the gas turbine and connected to the drive shaft 3 and the tension bolt 4 as aforementioned with respect to FIG. 3. Due to the bolt load transmission, a peak in the stress occurs at the edge 93 of the hub 60, which is not desirable due to the high stress concentration factor. The peak stress concentration at the edge 93 of the hub 60 in the conventionally known rotor disc 99 increases chances of failure of the rotor disc 99 and reduces life of the rotor disc 99. Furthermore, dishing of the rotor disc 99 may be undesirable due to the effect it may have on the turbine blade position during turbine blade rotation. Therefore, a technique is desired to reduce concentration of the aforementioned stress at the edge 93 of the hub 60 which occurs in the conventionally known rotor disc 99.

U.S. Pat. No. 4,844,694 discloses a fastening spindle and a method of attaching the rotor elements together utilizing the spindle. The system permits the visual inspection of the rotor assembly and to determine if it is properly tightened without the need for any additional post assembly inspection. The system and method is used for fastening a plurality of rotor elements together.

SUMMARY OF INVENTION

Thus the object of the present invention is to provide a technique for reducing stress concentration in a gas turbine rotor disc. It is desirable that the present technique provides reduction in stress concentration at the edge, opposite to the side of the rotor disc where the tension bolt load is applied, of the hub of the rotor disc.

The above objects are achieved by a gas turbine engine rotor disc of the present technique, a rotor disc assembly of the present technique and a gas turbine engine of the present technique. Advantageous embodiments of the present technique are provided in dependent claims. Features of the independent claims can be combined with features of dependent claims, and features of dependent claims can be combined together.

In the present technique a gas turbine engine rotor disc for a gas turbine engine is presented. The rotor disc includes a hub, a web, a blade retention arrangement, a rotational axis, a first axial side and a second axial side. The hub includes a central bore around the rotational axis. The web is integrally formed with the hub. The web extends radially outwards from the hub to the blade retention arrangement. The blade retention arrangement has a centre of mass. A radial plane passes through the centre of mass. The radial plane is perpendicular to the rotational axis. The first axial side is adapted for engaging a tension bolt of the gas turbine engine. The radial plane intersects the hub defining a first axial side portion and a second axial side portion. The first axial side portion is towards the first axial side and the second axial side portion is towards the second axial side. The second axial side portion has an axial extent which is between 10% and 30% greater than an axial extent of the first axial side portion.

The aforementioned design of the rotor disc, i.e. wherein the second axial side portion is axially longer than the first axial side portion by 10% to 30%, optimizes the stress profile within the hub and thereby reduces stress concentration at the edge of the hub. The added material, due to greater axial length of the second side of the hub, in the region of the high edge stress, offsets the peak stress and reduces the dishing. Thus, the aforementioned rotor disc experiences reduction in dishing of the rotor disc. The rotor disc of the present technique is particularly beneficial for use in turbine designs with thin discs that are prone to dishing, and that have a centre bolt or tension bolt design that can cause dishing of the end disc, that is the disc that is directly physically contacted with the centre bolt or the tension bolt, due to the staggered load transmission of the bolt-load.

In an embodiment of the gas turbine rotor disc, the second axial side portion has the axial extent which is between 20% and 25% greater than the axial extent of the first axial side portion.

In an embodiment of the gas turbine engine rotor disc, to determine the axial extents for the gas turbine rotor disc, measurements of the first axial extent and the second axial extent are limited to a region of the hub that has geometric similarity at the first axial side and the second axial side. In another embodiment of the gas turbine engine rotor disc, the region of the hub is free from an integrally formed connection projecting out from the hub and contacting one or more components of the gas turbine engine. In another embodiment of the gas turbine engine rotor disc, measurement of the first axial extent and the second axial extent are defined at an axial surface of the hub. The aforementioned embodiments provide simple ways of fixing or deciding the first and the second axial extents.

In another embodiment of the gas turbine engine rotor disc, the hub at the first axial side includes a chamfered recess adapted for engaging the tension bolt of the gas turbine engine. This provides a simple construct for positioning and integrating the rotor disc of the present technique into the gas turbine engine and in contact with the tension bolt of the gas turbine engine.

In another embodiment of the gas turbine engine rotor disc, the second axial side is adapted for engaging with a drive shaft of the gas turbine engine, for example via a Hirth coupling. This provides a simple construct for positioning and integrating the rotor disc of the present technique into the gas turbine engine and in contact with the drive shaft of the gas turbine engine.

In another aspect of the present technique, a gas turbine rotor disc assembly is presented. The gas turbine rotor disc assembly includes a gas turbine rotor disc and a plurality of turbine blades. The gas turbine rotor disc is according to the aforementioned aspect of the present technique. The turbine blades are arranged circumferentially at the blade retention arrangement of the rotor disc. The turbine blades extend radially outwards from the blade retention arrangement of the rotor disc. In the gas turbine rotor disc assembly of the present technique, the stress profile within the hub of the rotor disc is optimized and thereby stress concentration at the edge of the hub is reduced or obviated. The rotor disc experiences reduction in dishing. Due to the present rotor disc, the gas turbine of the present technique may be constructed with thinner than conventional rotor discs. Furthermore, the location of the blades of the gas turbine rotor disc assembly is free from or subjected to reduced effect from consequences of dishing of the rotor disc.

In yet another aspect of the present technique, a gas turbine engine is presented. The gas turbine engine includes a gas turbine rotor disc assembly. The gas turbine rotor disc assembly is according to the aforementioned aspect of the present technique. In the gas turbine engine of the present technique, the stress profile within the hub of the rotor disc is optimized and thereby stress concentration at the edge of the hub is reduced or obviated. The rotor disc experiences reduction in dishing. Due to the present rotor disc, the gas turbine of the present technique may be constructed with thinner than conventional rotor discs.

BRIEF DESCRIPTION OF THE DRAWINGS

The above mentioned attributes and other features and advantages of the present technique and the manner of attaining them will become more apparent and the present technique itself will be better understood by reference to the following description of embodiments of the present technique taken in conjunction with the accompanying drawings, wherein.

DETAILED DESCRIPTION OF INVENTION

Figure 1:
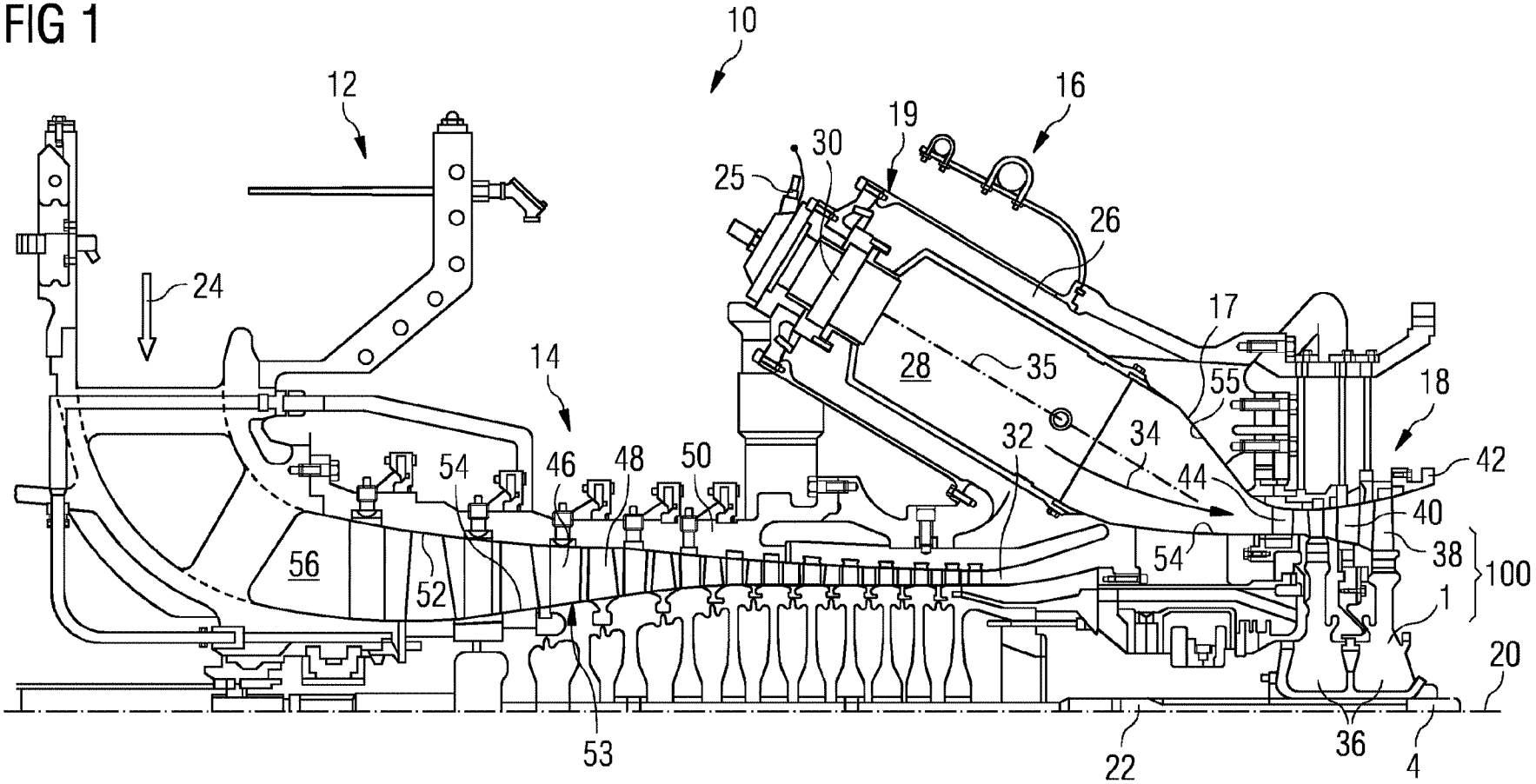
FIG. 1 shows part of a gas turbine engine in a sectional view and in which a gas turbine rotor disc of the present technique is incorporated or the gas turbine rotor disc assembly of the present technique is incorporated.

Hereinafter, above-mentioned and other features of the present technique are described in details. Various embodiments are described with reference to the drawing, wherein like reference numerals are used to refer to like elements throughout. In the following description, for the purpose of explanation, numerous specific details are set forth in order to provide a thorough understanding of one or more embodiments. It may be noted that the illustrated embodiments are intended to explain, and not to limit the invention. It may be evident that such embodiments may be practiced without these specific details.

It may be noted that in the present disclosure, the terms "first", "second", etc. are used herein only to facilitate discussion, and carry no particular temporal or chronological significance unless otherwise indicated.

FIG. 1 shows an example of a gas turbine engine 10 in a sectional view. The gas turbine engine 10 comprises, in flow series, an inlet 12, a compressor or compressor section 14, a combustor section 16 and a turbine section 18 which are generally arranged in flow series and generally about and in the direction of a longitudinal or rotational axis 20. The gas turbine engine 10 further comprises a shaft 22 which is rotatable about the rotational axis 20 and which extends longitudinally through the gas turbine engine 10. The shaft 22 drivingly connects the turbine section 18 to the compressor section 14.

In operation of the gas turbine engine 10, air 24, which is taken in through the air inlet 12 is compressed by the compressor section 14 and delivered to the combustion section or burner section 16. The burner section 16 comprises a longitudinal axis 35 of the burner, a burner plenum 26, one or more combustion chambers 28 and at least one burner 30 fixed to each combustion chamber 28. The combustion chambers 28 and the burners 30 are located inside the burner plenum 26. The compressed air passing through the compressor 14 enters a diffuser 32 and is discharged from the diffuser 32 into the burner plenum 26 from where a portion of the air enters the burner 30 and is mixed with a gaseous or liquid fuel. The air/fuel mixture is then burned and the combustion gas 34 or working gas from the combustion is channelled through the combustion chamber 28 to the turbine section 18 via a transition duct 17.

This exemplary gas turbine engine 10 has a cannular combustor section arrangement 16, which is constituted by an annular array of combustor cans 19 each having the burner 30 and the combustion chamber 28, the transition duct 17 has a generally circular inlet that interfaces with the combustor chamber 28 and an outlet in the form of an annular segment. An annular array of transition duct outlets form an annulus for channelling the combustion gases to the turbine 18.

The turbine section 18 comprises a number of blade carrying discs 36 attached to the shaft 22. In the present example, two discs 36 each carry an annular array of turbine blades 38. However, the number of blade carrying discs could be different, i.e. only one disc or more than two discs. In addition, guiding vanes 40, which are fixed to a stator 42 of the gas turbine engine 10, are disposed between the stages of annular arrays of turbine blades 38. Between the exit of the combustion chamber 28 and the leading turbine blades 38 inlet guiding vanes 44 are provided and turn the flow of working gas onto the turbine blades 38.

The combustion gas from the combustion chamber 28 enters the turbine section 18 and drives the turbine blades 38 which in turn rotates the shaft 22. The guiding vanes 40, 44 serve to optimise the angle of the combustion or working gas on the turbine blades 38.

The turbine section 18 drives the compressor section 14. The compressor section 14 comprises an axial series of vane stages 46 and rotor blade stages 48. The rotor blade stages 48 comprise a rotor disc supporting an annular array of blades. The compressor section 14 also comprises a casing 50 that surrounds the rotor stages and supports the vane stages 48. The guide vane stages include an annular array of radially extending vanes that are mounted to the casing 50. The vanes are provided to present gas flow at an optimal angle for the blades at a given engine operational point. Some of the guide vane stages have variable vanes, where the angle of the vanes, about their own longitudinal axis, can be adjusted for angle according to air flow characteristics that can occur at different engine operational conditions.

The casing 50 defines a radially outer surface 52 of the passage 56 of the compressor 14. A radially inner surface 54 of the passage 56 is at least partly defined by a rotor drum 53 of the rotor which is partly defined by the annular array of blades 48.

The present technique is described with reference to the above exemplary turbine engine having a single shaft or spool connecting a single, multi-stage compressor and a single, one or more stage turbine. However, it should be appreciated that the present technique is equally applicable to two or three shaft engines and which can be used for industrial, aero or marine applications.

The terms axial, radial and circumferential are made with reference to the rotational axis 20 of the engine, unless otherwise stated.

Figure 4:
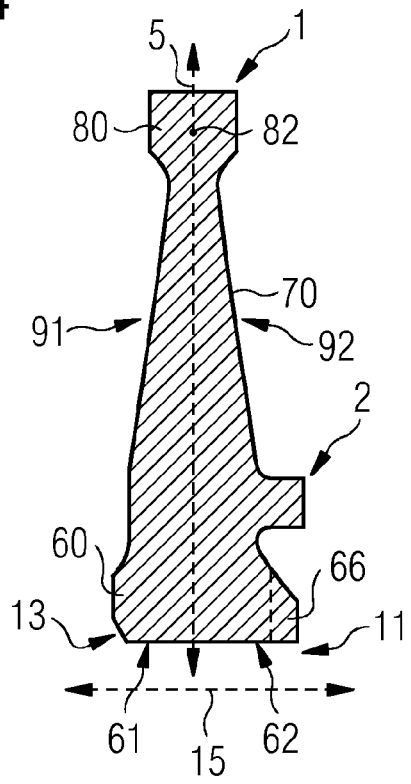
FIG. 4 schematically illustrates an exemplary embodiment of the gas turbine rotor disc of the present technique.
Figure 5:
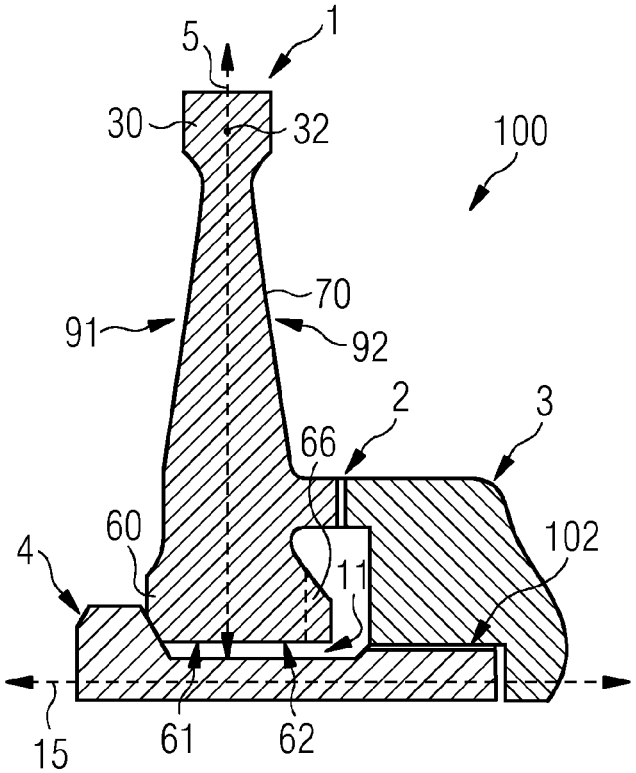
FIG. 5 schematically illustrates the gas turbine rotor disc of the present technique as arranged within the gas turbine.

FIG. 4 schematically illustrates an exemplary embodiment of a turbine engine rotor disc 1, and FIG. 5 schematically illustrates the turbine engine rotor disc 1 of FIG. 4 when incorporated with the gas turbine engine 10 of FIG. 1 and contacted with a tension bolt 4 on one side and with a drive shaft 3 on the other side of the rotor disc 1. A rotor disc retention assembly 100 of the gas turbine engine 10. The rotor disc retention assembly 100 comprises the tension bolt 4, the rotor disc 1 and the rotational axis 15. The tension bolt 4 and the rotor disc 1 are arranged around the rotational axis (15). The turbine engine rotor disc 1, hereinafter also referred to as the rotor disc 1, is one of the rotor discs 36 depicted in FIG. 1, particularly the rotor disc 1 is that rotor disc 36 that is contacted with the tension bolt 4. It may be noted that although only one rotor disc 1 is depicted between the tension bolt 4 and the drive shaft 3 in FIG. 5, there may be additional rotor discs 36 between the rotor disc 1 of FIG. 5 and the drive shaft 3 of FIG. 5. In such an arrangement with one or more rotor discs 36 in addition to the rotor disc 1 of the present technique, the rotor disc 1 of the present technique is contacted with an adjacent rotor disc 36 via a Hirth coupling 2, which may then be contacted with a subsequent adjacent rotor disc 36 via another Hirth coupling, and which in turn may be contacted to the drive shaft 3 via yet another Hirth coupling 2. In the aforementioned arrangement with one or more rotor discs 36 in addition to the rotor disc 1 of the present technique, the rotor disc 1 is that rotor disc that is directly contacted or connected to the tension bolt 4.

As depicted in FIGS. 4 and 5, the rotor disc 1 includes a hub 60, a web 70, a blade retention arrangement 80, a rotational axis 15, a first axial side 91 and a second axial side 92. The hub 60 is region or part of the rotor disc 99 that surrounds a central hole 11 or central bore 11. As shown in FIG. 5 the central bore 11 is arranged around the rotational axis 15 of the rotor disc 1 when the rotor disc 1 is positioned inside the gas turbine engine 10 of FIG. 1. From the hub 60 extends radially the web 70 which is section of the rotor disc 1 that connects the hub 60 to the blade retention arrangement 80. The blade retention arrangement 80 usually comprises slots (not shown) into which roots (not shown) of a plurality of the turbine blades 38 (shown in FIG. 1) are arranged or fixed. Thus the turbine blades 38 are circumferentially arranged on the rotor disc 1 and extend radially outwards, with respect to the rotational axis 15 or the rotational axis 20, from the rotor disc 1 and particularly outwards from the blade retention arrangement 80 of the rotor disc 1. The rotor disc 1 and the plurality of the turbine blades 38 arranged on the rotor disc 1 together form a turbine engine rotor disc assembly 100 as shown in FIG. 1. The rotational axis 15 of the rotor disc 1 overlaps the rotational axis 20 when the rotor disc 1 is positioned inside the gas turbine engine 10 of FIG. 1.

As shown in FIG. 5, a tension bolt 4 of the gas turbine engine 10 passes through the central bore 11 and is physically contacted at the first axial side 91 of the rotor disc 1. The tension bolt 4 bears the load of the turbine engine rotor disc assembly 100, i.e. of the rotor disc 1 and the turbine blades 38 arranged on the rotor disc 1, when the turbine engine rotor disc assembly 100 is rotated during operation of the gas turbine engine 10. On the second axial side 92 of the rotor disc 1, the rotor disc 1 is contacted or coupled with the drive shaft 3 of the gas turbine engine 10 via generally a Hirth coupling 2. The location of the Hirth coupling 2 is depicted in FIG. 4 although FIG. 4 does not schematically depict the Hirth coupling 2 in its entirety along with the drive shaft 3. The drive shaft 3 rotationally couples the gas turbine engine 10 to a downstream load for example a generator (not shown). The first and the second axial sides 91 and 92 are with respect to the rotational axis 15. The first axial side 91 is adapted for engaging the tension bolt 4 of the gas turbine engine 10. The first axial side 91 may include a chamfered recess 13 for receiving the tension bolt 4, as shown in FIGS. 4 and 5, or for receiving a nut head (not shown) connected to the tension bolt 4. FIG. 5 depicts the second axial side 92 connected to the drive shaft 3 via the Hirth coupling 2, however, as aforementioned the second axial side 92 may alternatively be connected to a subsequently arranged rotor disc 36 via the Hirth coupling 2.

The tension bolt 4 applies a compressive force across the disc 1 or a number of discs and to secure the disc or discs to the drive shaft 3. The tension bolt 4 is therefore in tension. The tension bolt 4 may be attached and tightened to the drive shaft by a spline arrangement 102.

Figure 6:
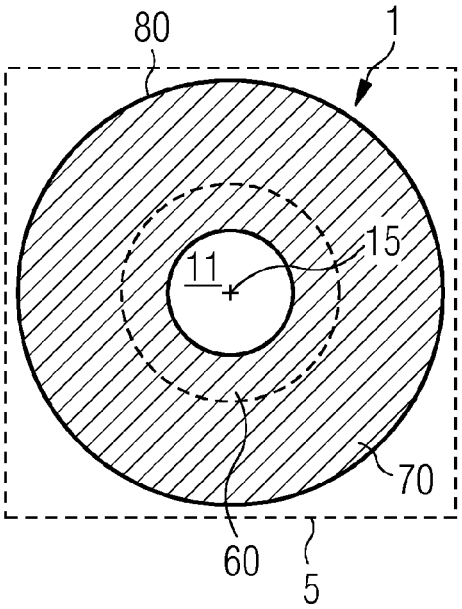
FIG. 6 schematically illustrates the gas turbine rotor disc of the present technique as viewed along a rotational axis of the gas turbine rotor disc of the present technique.

The blade retention arrangement 80 has a centre of mass 82. The centre of mass 82 may be a geometric centre of the blade retention arrangement 80 when the blade retention arrangement 80 is formed symmetrically and with a homogenous material. The blade retention arrangement 80 may be assumed to be divided by a radial plane 5 that passes through the centre of mass 82 of the blade retention arrangement 80 and is perpendicular to the rotational axis 15. FIGS. 4, 5 and 6 schematically depict the radial plane 5. The radial plane 5 extends through the rotor disc 1 intersecting the central bore 11, the hub 60, the web 70 and the blade retention arrangement 80.

Figure 7:
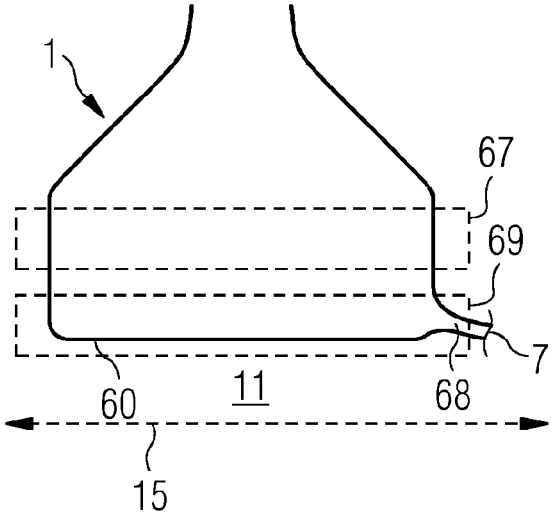
FIG. 7 schematically illustrates a way of determining a first and a second axial extent in the hub of the gas turbine rotor disc.
Figure 8:
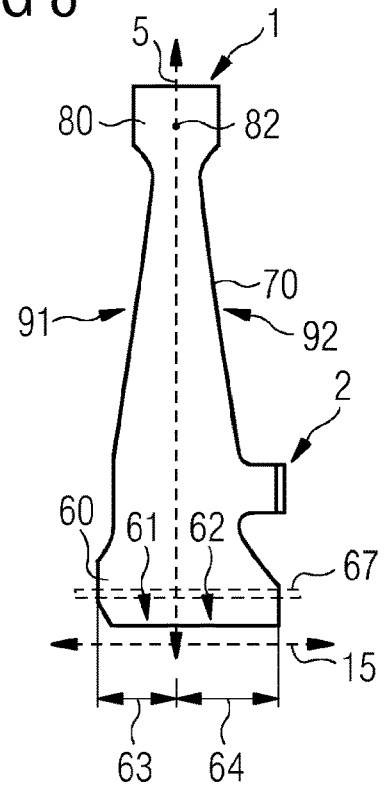
FIG. 8 schematically illustrates another way of determining the first and the second axial extent in the hub of the gas turbine rotor disc.
Figure 9:
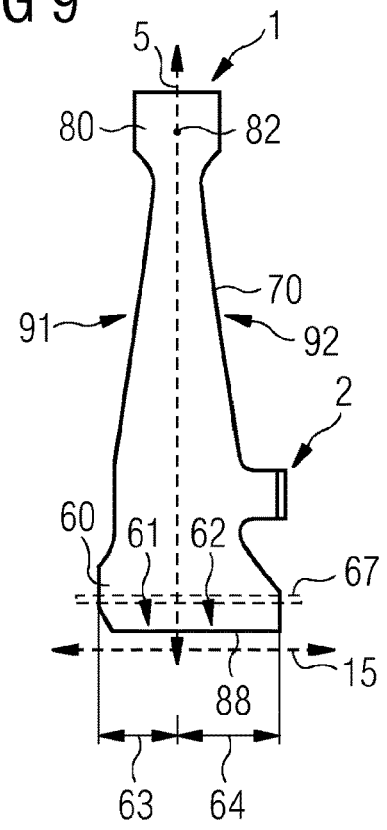
FIG. 9 schematically illustrates yet another way of determining the first and the second axial extent in the hub of the gas turbine rotor disc.

As shown in FIGS. 4 and 5, the radial plane 5 by intersecting the hub 60 defines a first axial side portion 61 in the hub 60 towards the first axial side 91 and a second axial side portion 62 in the hub 60 towards the second axial side 92. In the rotor disc 1, the second axial side portion 62 axially extends between 10% and 30% more than the first axial side portion 61. FIGS. 7, 8 and 9 present different ways of defining the axial extension of the first axial side portion 61 and the second axial side portion 62.

As shown in FIGS. 8 and 9, the first axial side portion 61 has an axial extent 63 and the second axial side portion 62 has an axial extent 64. According to the present technique, in the rotor disc 1, the axial extent 64 of the second axial side portion 62 is between 10% and 30% greater than the axial extent 63 of the first axial side portion 61.

As schematically depicted in FIG. 8, measurements of the first axial extent 63 and the second axial extent 64 are limited to a region 67 of the hub 60. In other words the measurement of the first axial extent 63 and the second axial extent 64 are performed within the region 67 of the hub 60. The measurements of the first axial extent 63 and the second axial extent 64 are performed in a continuous straight line perpendicular to the radial plane 5. The measurement or value of the first axial extent 63 is a measure of length or distance from the radial plane 5 to an edge of the first axial side 91 within the region 67, i.e. a measure of length of the first axial side portion 61. Similarly, the measurement or value of the second axial extent 64 is a measure of length or distance from the radial plane 5 to an edge of the second axial side 92 within the region 67, i.e. a measure of length of the second axial side portion 62. The region 67 of the hub 60 is a region or portion of the hub 60 that has geometric similarity at the first axial side 91 and the second axial side 92.

The geometric similarity as used herein means that within the region 67 the first and the second axial sides 91, 92 both have the same shape, or one has the same shape as the mirror image of the other, mirrored across the radial plane 5. An example of geometric similarity is when the axial sides 91, 92 have same or substantially similar angle of curvature at their respective edges within the region 67.

As shown in FIG. 7, the region 67 of the hub 60 is free from an integrally formed connection 68 projecting out from the hub 60. The integrally formed connection 68 may be adapted for contacting one or more components 7 of the gas turbine engine 10, for example a support extending from the hub 60 and adapted to contact a subsequent rotor disc (not shown). In another words, the measurement of the axial extents 63, 64 do not include any such integrally formed connections 68 and are limited to a main body of the hub 60. FIG. 7 depicts another region 69 in the hub 60 of the rotor disc 1. The region 69 shows the integrally formed connection 68 for example a projection 68 extending outward from the hub 60. While determining the axial extends 63, 64 i.e. while measuring the first and the second axial side portions 61, 62 the measurements are to be performed within the region 67 or of the region 67 and not within the region 69 or of the region 69.

As depicted in FIG. 9, the measurements of the axial extents 63, 64 are defined at an axial surface 88 of the hub 60. In other words the measurement or value of the first axial extent 63 is a measure of length or distance from the radial plane 5 to an edge of the axial surface 88 of the first axial side 91, i.e. a measure of length of the first axial side portion 61. Similarly, the measurement or value of the second axial extent 64 is a measure of length or distance from the radial plane 5 to an edge of the axial surface 88 of the second axial side 92 i.e. a measure of length of the second axial side portion 62. The axial surface 88 is a surface of the hub 60 that defines the central bore 11.

Figure 2:
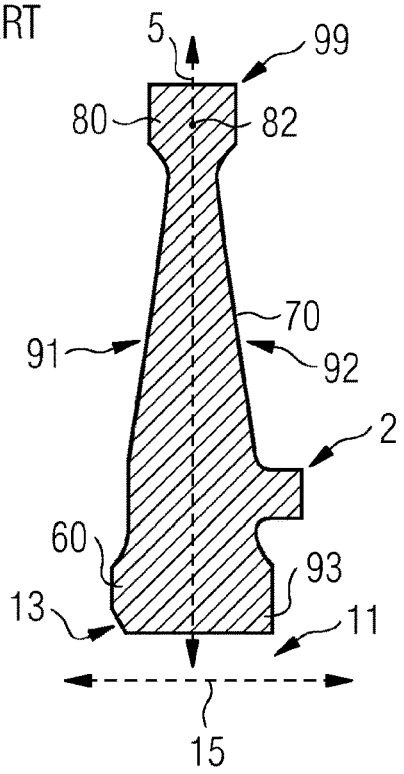
FIG 2 PRIOR ART
FIG. 2 schematically illustrates a conventionally known rotor disc.
Figure 3:
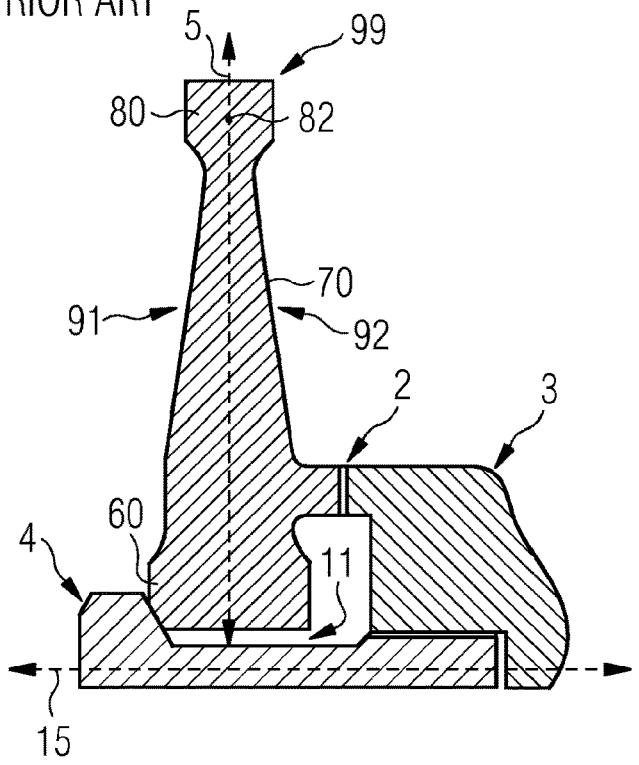
FIG 3 PRIOR ART
FIG. 3 schematically illustrates the conventionally known rotor disc as arranged within the gas turbine.
Figure 10:
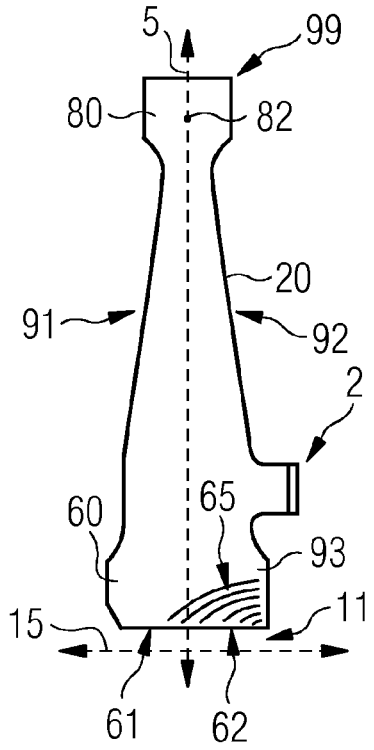
FIG. 10 schematically illustrates a stress profile in a hub of the conventionally known rotor disc of FIGS. 2 and 3.
Figure 11:
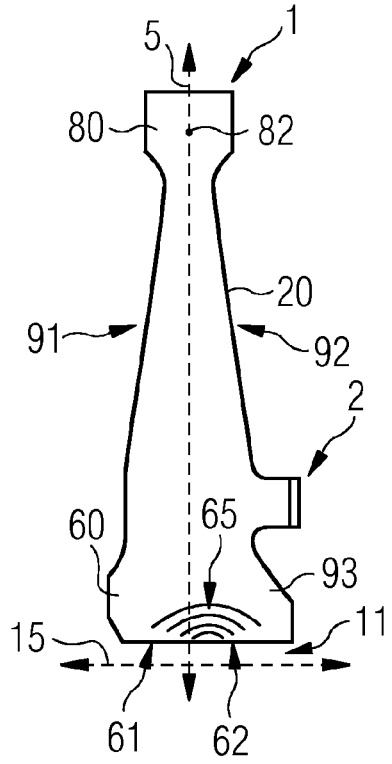
FIG. 11 schematically illustrates a stress profile in a hub of the gas turbine rotor disc of the present technique of FIGS. 4 and 5.

FIG. 11 schematically illustrates a stress profile in the hub 60 of the gas turbine rotor disc 1 of the present technique, for example in the exemplary embodiment of the rotor disc 1 as depicted in FIGS. 4 and 5. The stress profile in the hub 60 of the rotor disc 1 may be understood comparatively with respect to the stress profile in the hub 60 of the conventionally known rotor disc 99 as depicted in FIG. 10 for the conventionally known rotor disc 99 shown in FIGS. 2 and 3.

In the rotor disc 1 of the present technique, due to greater axial extent 64 of the second axial side portion 62, the stress concentration is optimized and distributed differently as compared to the stress profile depicted in FIG. 10 for the conventionally known rotor disc 99. Due to the increased axial extent 64 of the second axial side portion 62, the peak stress is formed substantially towards a centre of the hub 60, instead of being formed at the edge 93 as aforementioned in case of the stress profile depicted in FIG. 10 for the conventionally known rotor disc 99.

It may be noted that the greater axial extent of the second axial side portion 62 as compared to the first axial side portion 61 results from having more material of the hub 60 at the second axial side portion 62 as compared to the first axial side portion 61 of the hub 60, however the increase in the axial extent i.e. addition of the more material at the second axial side portion 62 as compared to the first axial side portion 61 of the hub 60 is not done as a separate component, the hub 60 including the first axial side portion 61 and the second axial side portion 62 is formed integrally as a single body along with the web 70 and the blade retention arrangement 80.

While the present technique has been described in detail with reference to certain embodiments, it should be appreciated that the present technique is not limited to those precise embodiments. Rather, in view of the present disclosure which describes exemplary modes for practicing the invention, many modifications and variations would present themselves, to those skilled in the art without departing from the scope and spirit of this invention. The scope of the invention is, therefore, indicated by the following claims rather than by the foregoing description. All changes, modifications, and variations coming within the meaning and range of equivalency of the claims are to be considered within their scope.

The invention claimed is:

1. A rotor disc retention assembly of a gas turbine engine, the rotor disc retention assembly comprising:

a tension bolt, a rotor disc and a rotational axis; the tension bolt and the rotor disc are arranged around the rotational axis;

wherein the rotor disc comprises:

a hub, a web, a blade retention arrangement, the rotational axis, a first axial side and a second axial side, the hub having a central bore around the rotational axis, the web integrally formed with and extending radially outwards from the hub to the blade retention arrangement;

the blade retention arrangement has a centre of mass and a radial plane passes through the centre of mass and perpendicular to the rotational axis, the first axial side engages the tension bolt; and the radial plane intersects the hub defining a first axial side portion towards the first axial side and a second axial side portion towards the second axial side, wherein the second axial side portion has a second axial extent between 10% and 30% greater than a first axial extent of the first axial side portion.

2. The rotor disc retention assembly according to claim 1, wherein the second axial extent of the second axial side portion is between 20% and 25% greater than the first axial extent of the first axial side portion.

3. The rotor disc retention assembly according to claim 1, wherein measurements of the first axial extent and the second axial extent are limited to a region of the hub that has geometric similarity at the first axial side and the second axial side.

4. The rotor disc retention assembly according to claim 3, wherein the region of the hub is free from an integrally formed connection projecting out from the hub and adapted for contacting one or more components of the gas turbine engine.

5. The rotor disc retention assembly according to claim 1, wherein measurements of the first and second axial extents are defined at an axial surface of the hub.

6. The rotor disc retention assembly according to claim 1, wherein the hub at the first axial side comprises a chamfered recess adapted for engaging the tension bolt of the gas turbine engine.

7. The rotor disc retention assembly according to claim 1, wherein the rotor disc retention assembly comprises a drive shaft, and the second axial side engages the drive shaft.

8. The rotor disc retention assembly according to claim 7, wherein the second axial side engages the drive shaft of the gas turbine engine via a Hirth coupling.

9. The rotor disc retention assembly according to claim 1, wherein the tension bolt and the rotor disc are coaxial with one another around the rotational axis.

* * * * *